US005199497A

United States Patent [19]

Ross

[11] Patent Number: 5,199,497

[45] Date of Patent: Apr. 6, 1993

[54] SHAPE-MEMORY ACTUATOR FOR USE IN SUBTERRANEAN WELLS

[75] Inventor: Richard J. Ross, Houston, Tex.

[73] Assignee: Baker Hughes Incorporated, Houston, Tex.

[21] Appl. No.: 835,775

[22] Filed: Feb. 14, 1992

[51] Int. Cl.[5] ..... E21B 23/00

[52] U.S. Cl. ..... 166/381; 166/138; 166/216; 277/117; 148/402

[58] Field of Search ..... 166/120, 123, 134, 387, 166/250, 119, 138; 277/117-119

[56] References Cited

U.S. PATENT DOCUMENTS

| | | | |
|---|---|---|---|
| 2,202,887 | 6/1940 | Aloi | 164/0.5 |
| 2,266,355 | 12/1941 | Chun | 164/0.5 |
| 2,651,371 | 9/1953 | Toelke et al. | 166/13 |
| 3,174,851 | 3/1965 | Buehler et al. | 75/170 |
| 3,180,419 | 4/1965 | Cochran et al. | 166/120 |
| 3,342,267 | 9/1967 | Cotter et al. | 166/60 |
| 3,351,463 | 11/1967 | Buehler et al. | 75/170 |
| 3,356,139 | 12/1967 | Lamb et al. | 166/119 |
| 3,403,238 | 9/1968 | Buehler et al. | 337/393 |
| 3,416,607 | 12/1968 | Anastasiu et al. | 166/57 |
| 3,425,489 | 2/1969 | Brown | 166/138 |
| 3,666,030 | 5/1972 | Bohn et al. | 175/4.56 |
| 3,722,898 | 3/1973 | von Benningsen | 277/206 |
| 4,131,287 | 12/1978 | Gunderson et al. | 277/191 |
| 4,296,806 | 10/1981 | Taylor et al. | 166/120 |
| 4,588,029 | 5/1986 | Blizzard | 166/120 |
| 4,588,030 | 5/1986 | Blizzard | 166/120 |
| 4,595,053 | 6/1986 | Watkins et al. | 166/209 |
| 4,665,979 | 5/1987 | Boehm, Jr. | 166/208 |
| 4,742,874 | 5/1988 | Gullion | 166/348 |
| 4,790,572 | 12/1988 | Slyker | 277/117 X |
| 4,862,961 | 9/1989 | Neff | 166/138 |
| 4,864,824 | 9/1989 | Gabriel et al. | 60/527 |
| 4,899,543 | 2/1990 | Romanelli et al. | 60/527 |
| 4,900,041 | 2/1990 | Hopkins et al. | 277/117 X |
| 4,945,727 | 8/1990 | Whitehead et al. | 60/527 |
| 4,955,196 | 9/1990 | Lin et al. | 60/527 |

OTHER PUBLICATIONS

Stoeckel, "Shape-Memory Alloys Prompt New Actuator Designs" Advanced Materials & Processes, Oct., 1990.

Berry et al., "An Overview of the Mechanical Behavior and Applications of Memory Metals", Society for Experimental Mechanics—Spring Conference on Experimental Mechanics, Jun. 4-6, 1990.

Vandeveken et al., "Influence of Thermomechanical Treatments and Cycling on the Martensitic Transformation and Shape Recovery of Fe-Mn-Si Alloys" The Martensitic Transformation in Science and Technology Conference, Oct., 1989.

*Primary Examiner*—Ramon S. Britts
*Assistant Examiner*—Frank S. Tsay
*Attorney, Agent, or Firm*—Melvin A. Hunn

[57] ABSTRACT

The present invention is a wellbore tool which includes as a component an actuator which is composed at least in-part of a shape-memory material characterized by having a property of switching between a deformed shape and a pre-deformed shape upon receipt of thermal energy of a preselected amount. The wellbore tool further includes a component which is movable in position relative to a wellbore tubular conduit into a selected one of a plurality of configurations. The plurality of configurations include a first configuration with the first component in a first position relative to the wellbore tubular conduit, and corresponding to a first mode of operation of the wellbore tool. The plurality of configurations also includes a second configuration with the first component in a second position relative to the wellbore tubular conduit, and corresponding to a second mode of operation in the wellbore tool. The first and second components are physically linked in a manner to transfer motion of a second portion to the first portion. Means is provided for selectively providing thermal energy to at least the second component in an amount of at least the preselected amount of thermal energy required to cause the second portion to switch between the deformed shape and the predeformed shape, resulting in the first component moving from the first position to the second position to urge the wellbore tool from the first mode of operation to the second mode of operation.

24 Claims, 4 Drawing Sheets

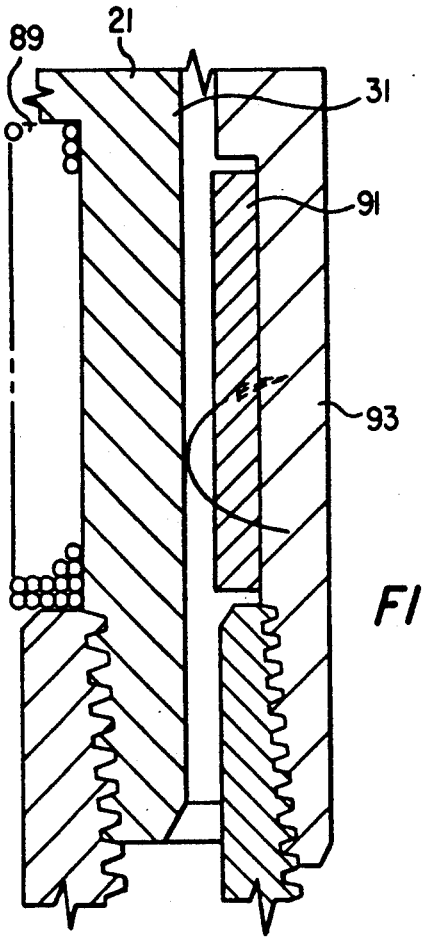
FIG. 4a
FIG. 4b
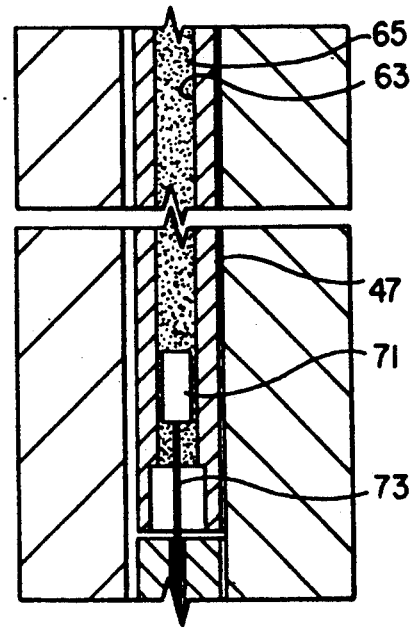
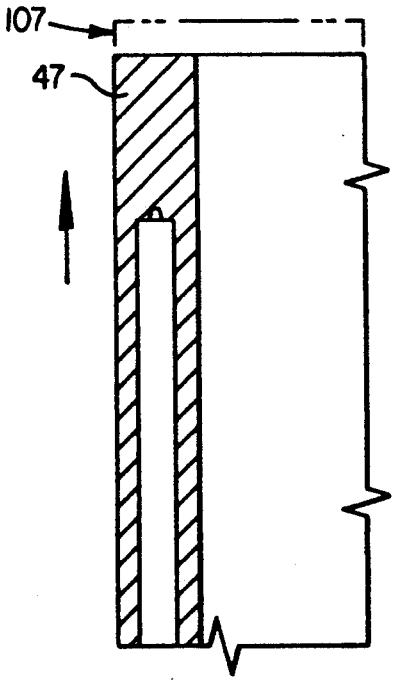
FIG. 4c
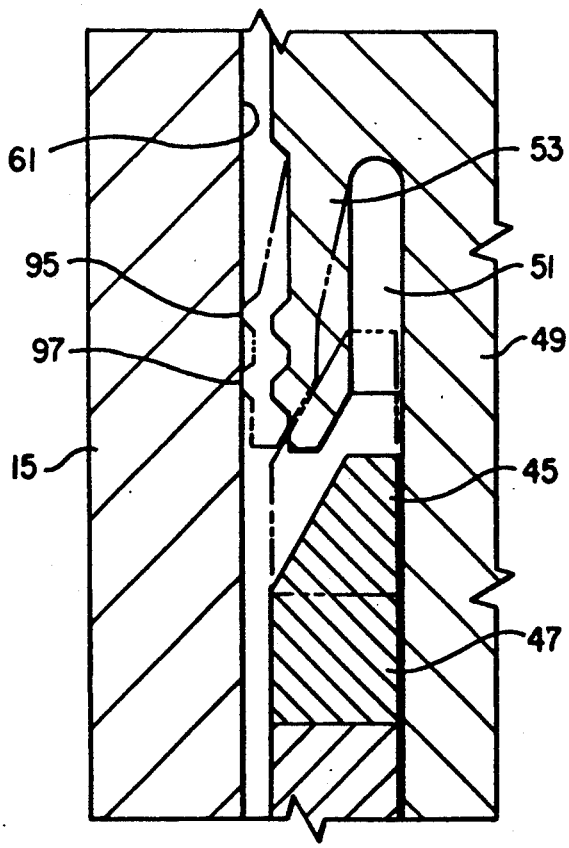
FIG. 4d

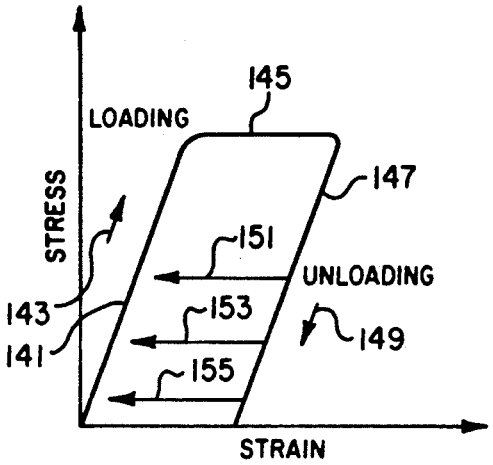
FIG. 6a
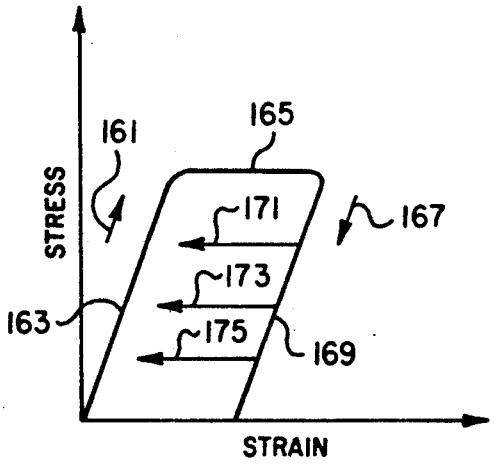
FIG. 6b
FIG. 7
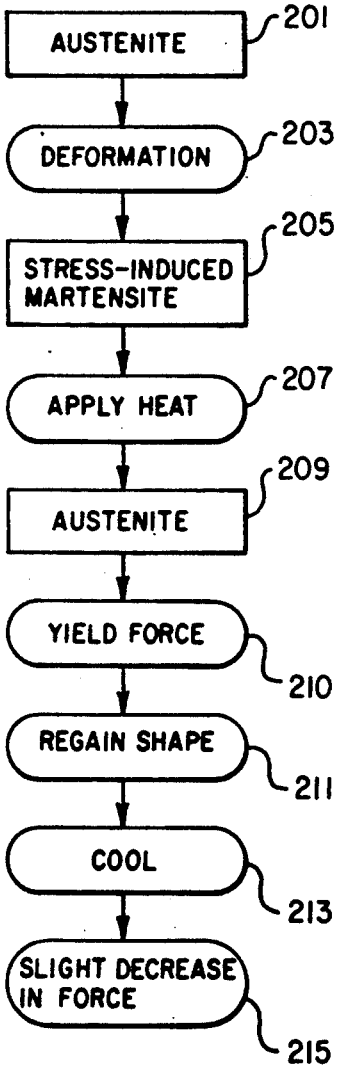

SHAPE-MEMORY ACTUATOR FOR USE IN SUBTERRANEAN WELLS

BACKGROUND OF THE INVENTION

1. Field of the Invention

The present invention relates generally to actuators used in subterranean wellbores, and specifically to actuators for use with subterranean wellbore tools which are operable in a plurality for operating modes and switchable between selected operating modes by application of axial force.

2. Description of the Prior Art

A variety of conventional wellbore tools which seal, pack, hang, and connect with or between concentrically nested wellbore tubular members are set into position by application of axial forces to the tool, such as, for example, by either lifting up on a tubular string to lessen the load on a tool, or by applying a selected amount of set down weight to the tubular string, to cause selected components to move relative to one another. For example, liner hangers frequently include slip and cone assemblies which are loaded to cause a portion of the assembly to come into gripping engagement with a selected wellbore surface. For alternative example, packers frequently include elastomeric sleeves which are compressed and energized to urge the sleeve into sealing engagement with a selected wellbore surface.

Of course, these types of wellbore tools require that operations usually performed at the surface cause an intended effect at a remote location deep within the wellbore, and in particular require that axial force be transferred effectively over great distances, even in difficult wellbores, such as deviated or spiral-shaped wellbores. Those knowledgeable about wellbore completion operations will appreciate that a force-transmitting tubular string may contact other wellbore tubulars or wellbore surfaces at a number of locations, dissipating the axial setting force which is intended for application at another location, and frustrating completion operations.

Another related problem with the prior art devices is that the wellbore tool may be unintentionally subjected to axial, or other, loads during running of the tool into the wellbore, which may cause unintentional setting of the tool in an undesirable or unintended location. Since many wellbore tools, such as liner hangers or packers, are designed to permanently lock in a set position, such as accidental setting can result in extremely expensive and time-consuming retrieval operations.

In prior art devices, the interconnected components which are intended, and engineered, to provide a permanent lock may, themselves, present operating problems, once the tool is disposed at a desired location within the wellbore, since they may either fail to operate properly during setting procedures, or to operate for the duration of the intended "life" of the tool. Failures can occur for a number of reasons, most of which are attributable to the harsh wellbore environments frequently encountered. The unsetting of wellbore tools which are intended for permanent placement can have disastrous financial and engineering consequences.

SUMMARY OF THE INVENTION

It is one objective of the present invention to provide an actuator device for use in subterranean wellbores which provides an extremely-high, localized, preselected axial setting force level.

It is another objective of the present invention to provide an actuator device for use in a subterranean wellbore which is conveyed within a wellbore on wellbore tubular members, but which is insensitive to axial loading, or other loading, of the wellbore tubular member, and is thus unlikely to become unintentionally or inadvertently triggered.

It is still another objective of the present invention to provide an actuator device which is thermally triggered to move between operating positions, but which is insensitive to ambient temperatures typically encountered within wellbores.

It is yet another objective of the present invention to provide an actuator device for use in subterranean wellbores, which is irreversibly urged between pre-actuation and post-actuation positions.

It is still another objective of the present invention to provide an actuator device for use in a subterranean wellbore which depends upon a single moving part in moving between pre-actuation and post-actuation conditions.

It is yet another objective of the present invention to provide an actuator device for use in a subterranean wellbore which includes a forcetransmitting member which maintains a substantially constant force level without reliance upon mechanical linkages, connections, or couplings, thus providing a force level which is not dependent upon the integrity or longevity of linkages, connections, or couplings as are prior art wellbore actuators.

These and other objectives are achieved as is now described. The present invention is a wellbore tool which includes a first component an actuator which is composed at least in-part of a shape-memory material, which is a material characterized by having a property of switching between a deformed shape and a predeformed shape upon receipt of themal energy of a preselected amount. The wellbore tool further includes a second component which is movable in position relative to a wellbore tubular conduit into a selected one of a plurality of configurations. The plurality of configurations include a first configuration with the first component in a first position relative to the wellbore tubular conduit, such position corresponding to a first mode of operation of the wellbore tool. The plurality of configurations also includes a second configuration with the first component in a second position relative to the wellbore tubular conduit, such position corresponding to a second mode of operation in the wellbore tool. The first the second components are physically linked in a manner to transfer motion of the second portion to the first portion. Means is provided for selectively providing thermal energy to at least the second component in an amount of at least the preselected amount of thermal energy required to cause the second portion to switch between the deformed shape and the predeformed shape, resulting in the first component moving from the first position to the second position to urge the wellbore tool from the first mode of operation to the second mode of operation.

In the preferred embodiment of the present invention, the wellbore tool includes at least one heating channel disposed within the shape-memory material, and a selectively-activated exothermeric substances disposed within the heating channel. In this particular embodiment, the means for selectively providing thermal energy comprises a device for selectively activating the exothermic substance to release thermal energy in an amount of at least the preselected amount, causing the second component to switch between deformed and pre-deformed shapes.

Additional objectives, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIGS. 4*a* through 4*d* are longitudinal section views of portions of the preferred embodiment of the wedge-set sealing flap of the present invention, in time sequence order, to depict the setting of the wedge-set sealing flap.

FIGS. 6*a* and 6*b* depict in graph form the stress-strain relationship of Nickle, Copper, and Iron based shape-memory;

FIG. 7 depicts in flowchart form the process steps of using Iron-based shape-memory alloys.

DETAILED DESCRIPTION OF THE INVENTION

Figure 1A:
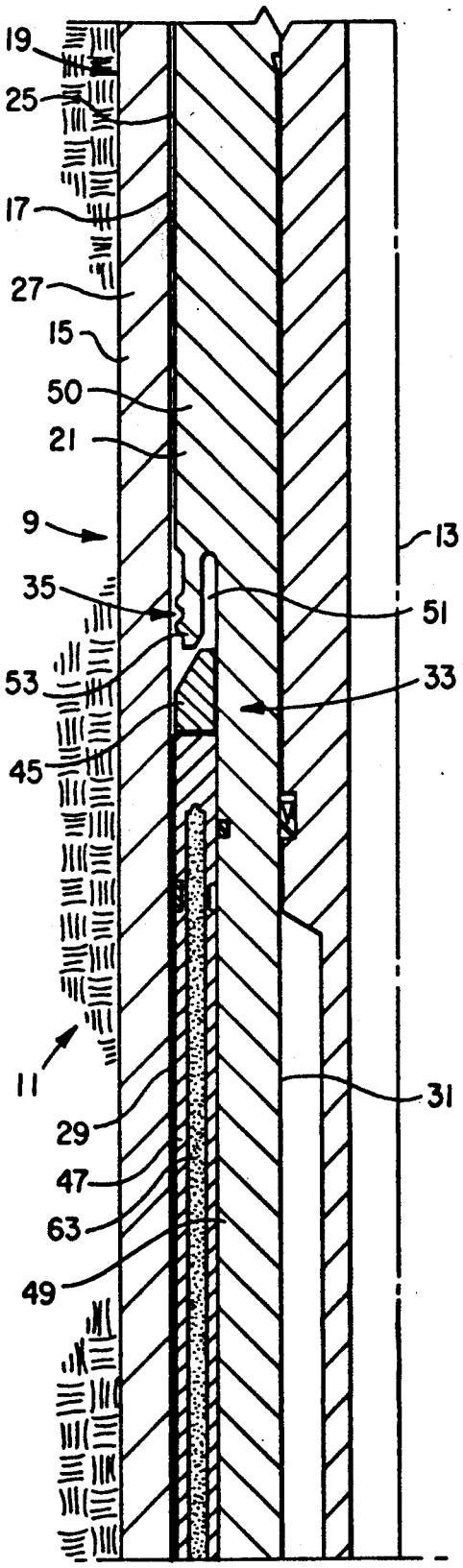
FIGS. 1*a* and 1*b* are longitudinal section views of a portion of the preferred embodiment of the wedge-set sealing flap of the present invention, with FIG. 1*b* being a continuation of FIG. 1*a*.
Figure 1B:
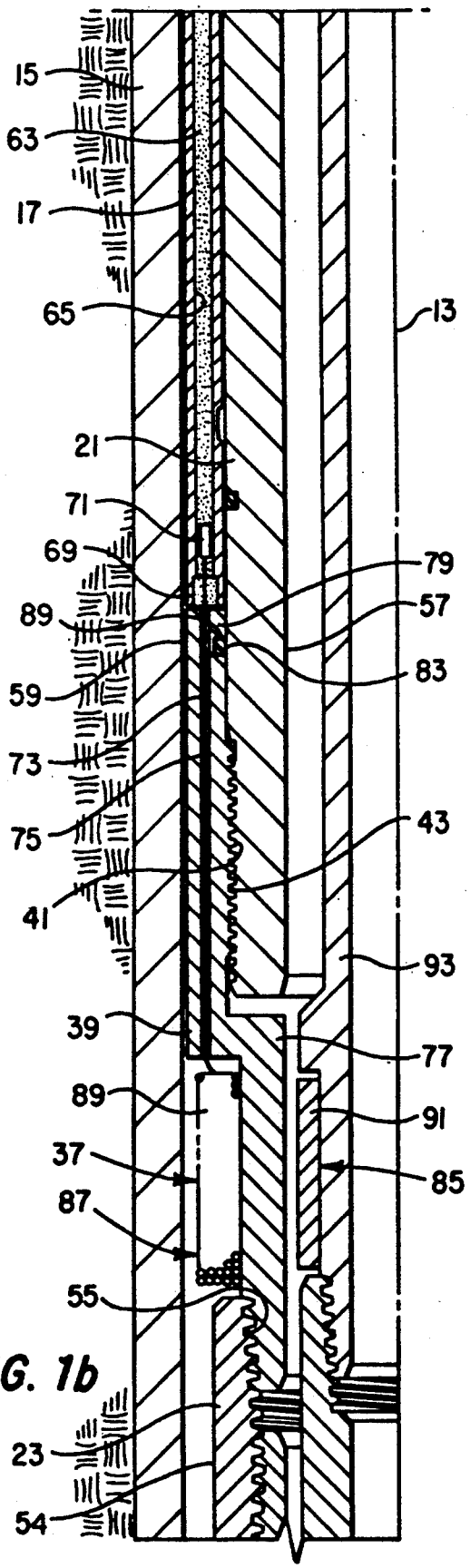

In FIG. 1 wellbore tool 11 is shown disposed within wellbore 9, and includes a number of components which are annular in shape and disposed about longitudinal axis 13. To simplify the depiction of the preferred embodiment of the present invention, FIGS. 1*a* and 1*b* are longitudinal section views of one-half of wellbore tool 11, which is in actuality symmetrical about longitudinal axis 13. In addition, FIGS. 1*a* and 1*b* should be read together, with FIG. 1*a* representing the uppermost portion of wellbore tool 11, and FIG. 1*b* representing the lowermost portion of wellbore tool 11. As shown in these figures, wellbore tool 11 is especially suited for use in a wellbore having a plurality of concentrically-nested tubular members therein. For purposes of simplicity, FIGS. 1*a* and 1*b* show only wellbore tubular conduit 15 disposed within wellbore 9, but the concepts of the present invention are equally applicable to wellbores which include a greater number of concentrically nested tubular members. As shown, wellbore tool 11 of the present invention itself includes at least one additional wellbore tubular member. All tubular members shown in FIGS. 1*a* and 1*b* can comprise lengthy strings of tubular members which extend deep into wellbore 9 from the earth's surface.

Preferred wellbore tool 11 of the present invention includes cylindrical mandrel 21 which is preferably coupled at its uppermost and lowermost ends to other tubular members, together comprising a tubular string which extends upward and downward within wellbore 9. FIG. 1*b* depicts one of such couplings, namely threaded coupling 55 between the lowermost end of cylindrical mandrel 21 and wellbore tubular conduit 23.

One particular application of the preferred embodiment of wellbore tool 11 would be as a component in a liner hanging assembly, in which wellbore tubular conduit 15 is a string of casing which extends into wellbore 9 with cylindrical mandrel 21 being one component in a liner hanger assembly, which functions to grippingly and sealingly engage wellbore surface 17 of the casing. However, it is not intended that the present invention be limited in application to liner hanger assemblies.

With continued reference to FIGS. 1*a* and 1*b*, as shown, the tubing string which includes cylindrical mandrel 21 and wellbore tubular conduit 23 includes inner and outer cylindrical surfaces 57, 59, with inner surface 57 defining central bore 31 which allows fluids to pass upward and downward within wellbore 9. A narrow annular region 25 is provided between wellbore tubular conduit 15 and cylindrical mandrel 21. It is one objective of the preferred embodiment of the present invention to provide for sealing engagement between cylindrical mandrel 21 and wellbore tubular conduit 15, with wedge-set sealing flap 35 in sealing engagement with wellbore tubular conduit 15 to prevent the passage of fluid (that is, broadly speaking, both liquids and gasses) between upper and lower annular regions 27, 29.

Figure 3:
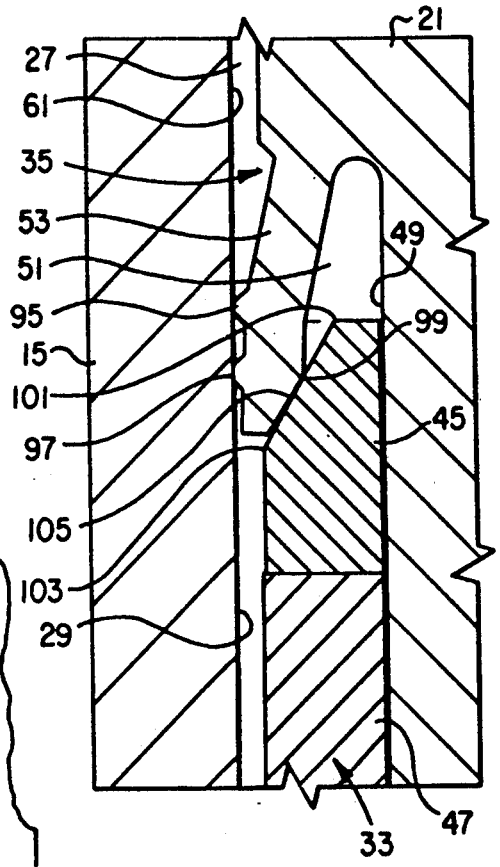
FIG. 3 is a longitudinal section view of a portion of the preferred embodiment of the wedge-set sealing flap of the present invention, in a sealing position.

Preferably, wedge-set sealing flap 35 is operable in a plurality of modes, including a radially-reduced running mode (which is depicted in FIGS. 1*a* and 1*b*) and a radially-expanded sealing mode with wedge-set sealing flap 35 urged into sealing contact with inner surface 61 of wellbore tubular conduit 15, as is shown in the partial longitudinal section view of FIG. 3. In the preferred embodiment of the present invention, wedge-set sealing flap 35 is integrally formed in cylindrical mandrel 21, which includes a radially-reduced portion 49 and radially-enlarged portion 50. Sealing flap 53 extends radially outward from the portion of radially-reduced portion 49. Preferably, annular cavity is formed between sealing flap 53 and radially-reduced portion 49.

Wedge-set sealing flap 35 is moved between the radially-reduced running position and the radially-enlarged sealing position by operation of shape-memory actuator 33. Viewed broadly, shaped-memory actuator 33 includes first component 45 which is movable relative to radially-reduced portion 49 into a selected one of a plurality of configurations, including at least a first configuration with the first component 45 in a first position relative to cylindrical mandrel 21 corresponding to the running mode of operation of wellbore tool 11, and a second configuration with first component 45 in a second position relative to cylindrical mandrel 21 corresponding to a sealing mode of operation of wellbore tool 11. Shape-memory actuator 33 further includes a second component 47 which at least in-part includes a shape-memory material characterized by having a property of switching between a deformed shape and pre-deformed shape upon receipt of thermal energy of a preselected amount. In the preferred embodiment described herein, first and second components 45, 47 are axially aligned along radially-reduced portion 49 of cylindrical mandrel 21, and are not coupled or linked together. However, in alternative embodiments, first and second components 45, 47 may be integrally formed, or otherwise coupled or linked together, in a manner to ensure transfer of motion of second component 47 to first component 45 to accomplish the setting of wedge-set sealing flap 35 against wellbore tubular conduit 15, providing a high-integrity seal between upper and lower annular regions 27, 29. In still other alternative embodiments, both first and second components 45, 47 may be formed of shape-memory material.

Figure 2:
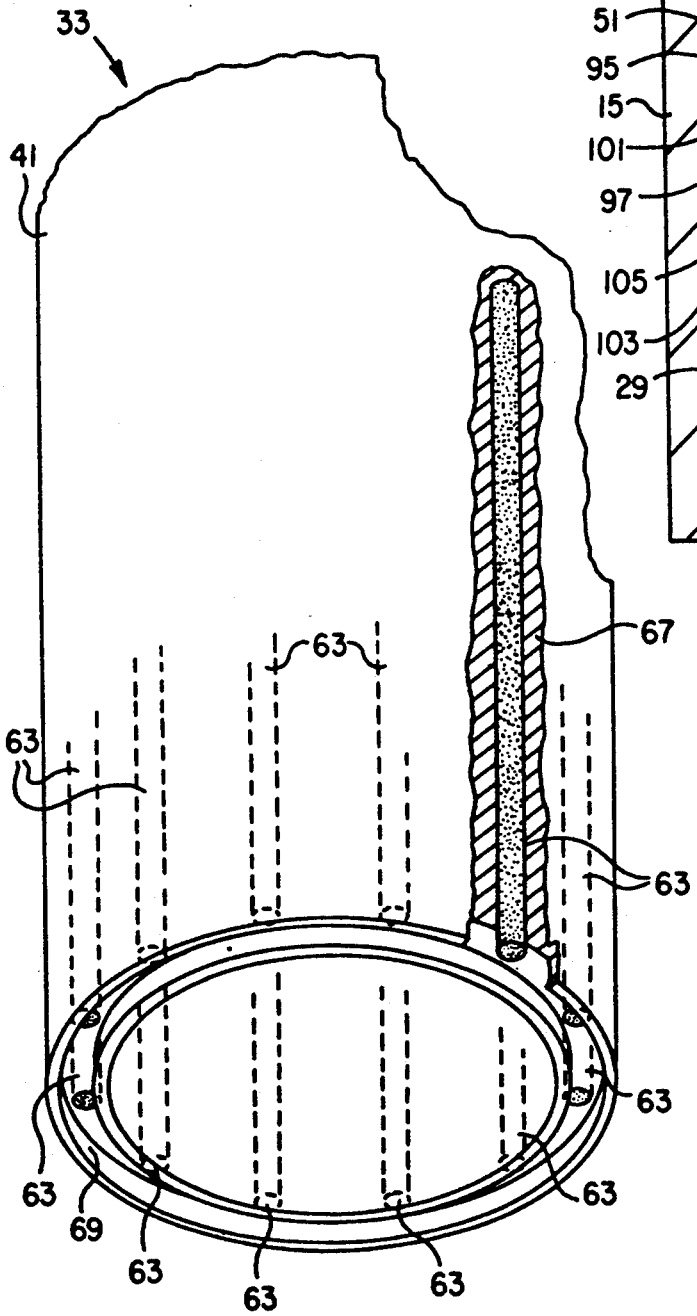
FIG. 2 is a fragmentary perspective view of a portion of a shape-memory actuator, which is used to set the preferred embodiment of the wedge-set sealing flap of the present invention, with portions depicted in cutaway and phantom view.

The wellbore tool of the present invention requires a mechanism for providing thermal energy to shape-memory actuator 33, which will now be described. As shown in FIGS. 1*a* and 1*b*, second component 47 of shape-memory actuator 33 has at least one heating channel 63 disposed therein, and filled with a selectively-activated exothermic substance 65. The preferred embodiment of the present invention of wellbore tool 11 is more clearly depicted in FIG. 2, which is a fragmentary perspective view of a portion of the preferred embodiment of the shape-memory actuator 33 of the present invention, with portions depicted in cut-away and phantom view. As shown, second component 47 of shape-memory actuator 33 is cylindrical in shape, and is preferably formed at least in-part of shape-memory material 67. A plurality of axially-aligned heating channels 63 are provided within the shape-memory material 67 of second component 47 and are arranged in a balanced configuration with each channel being spaced a selected radial distance from adjacent heating channels 63. An annular groove 69 is provided at the lowermost end of second component 47 of shape-memory actuator 33, and is adapted for also receiving selectively-activated exothermic substance 65, and thus linking each of the plurality of heating channels 63 to one another. In the preferred embodiment, selectively-activated exothermic substance 65 comprises strong oxidizing compounds, fuels, and fillers, similar to that which is ordinarily found in road flares and solid fuel rocket engines, and which can be used to selectively heat second component 47 above 300 degrees Fahrenheit, as will be discussed below. The materials which comprise shape-memory material 67 will be discussed herebelow in greater detail.

With reference again to FIGS. 1*a* and 1*b*, In the preferred embodiment of the present invention, selectively-activated exothermic substance 65 is ignited by a conventional heat generating ignitor 71 which is disposed at the lowermost end of second component 47 of shape-memory actuator 33 and embedded in the selectively actuated exothermic substance 65. Electrical conductor 73 is coupled to ignitor 71, and serves to selectively provide an electrical actuation signal to ignitor 71 which fires ignitor 71, causing an exothermic reaction from selectively-activated exothermic substance 65, which generates heat throughout heating channels 63, uniformly providing a predetermined amount of thermal energy to the shape-memory material 67 of second component 47 of shape-memory actuator 33.

Conductor cavity 75 is provided within non-magnetic tool joint 77 which includes external threads 41 which couple with internal threads 43 of cylindrical mandrel 21. The uppermost portion of non-magnetic tool joint 77 is concentrically disposed over a portion of the exterior surface of cylindrical mandrel 21, forming buttress 79 which is in abutment with the lowermost portion of second component 47 of shape-memory actuator 33. O-ring seal 81 is provided in O-ring seal groove 83 on the interior surface of non-magnetic tool joint 77 to provide a fluid-tight and gas-tight seal at the connection of internal and external threads 41, 43. Electrical conductor 73 extends downward through conductor cavity 75 to a lowermost portion of non-magnetic tool joint 77 and couples to firing mechanism 37.

Firing mechanism 37 includes electromagnetic transmitter portion 85 and electromagnetic receiver portion 87, which cooperate to transmit an actuation current which serves to energize (and, thus detonate) ignitor 71, triggering an exothermic reaction from selectively-actuated exothermic substance 65. In the preferred embodiment of the present invention, electromagnetic transmitter portion 85 comprises permanent magnet 91 which is selectively conveyed into position within wellbore 9 on workstring 93, for placement in a selected position relative to cylindrical mandrel 21. Preferably, workstring 93 is disposed radially inward from cylindrical mandrel 21, and is raised and lowered within central bore 31 of the tubing string which includes cylindrical mandrel 21. In the preferred embodiment, electromagnetic receiver portion 87 comprises a conductor coil 89 which is preferably an insulated copper conductive wire which is wound about non-magnetic tool joint 39 a plurality of turns, and which is electrically coupled to electrical conductor 73.

Together, ignitor 71, electrical conductor 73, and conductor coil 87 form a single electrical circuit. Conductor coil 87 is sensitive to magnetic fields generated by rotation of permanent magnet 91, and will generate an electric current in response to rotation of workstring 93 relative to cylindrical mandrel 21. Preferably, workstring 93 is rotated at a rate of between fifty and one hundred revolutions per minute. Conductor coil 89 need only generate a current sufficient to fire ignitor 71. The current may be calculated by conventional means, and depends upon the conductivity of the conductor coil 89, the cross-section area of conductor coil 89, the number of turns of wire contained in conductor coil 89, and the strength of permanent magnet 91. Preferably, a conventional ignitor 71 is employed, which requires a known amount of current for effecting firing. The requirements of ignitor 71 can be used to work backward to determine the design requirements for the gauge of the wire of conductor coil 89, the conductivity of the wire of conductor coil 89, the number of turns of conductor coil 89, and the strength of permanent magnet 91, and the rotation speed required of workstring 93. Permanent magnet 91 may include alternating regions of magnetized and non-magnetized material. Non-magnetic tool joint 77 is preferably formed of a non-magnetic material to allow the magnetic field from permanent magnet 91 to penetrate the tool joint, and is preferably formed of Monel.

The magnetic field produced by rapid rotation of permanent magnet 91 on workstring 93 produces a magnetic field which is not usually encountered in the wellbore, thus providing an actuation signal which is unlikely to be encountered accidentally in the wellbore during run-in operations. Firing mechanism 37 is further advantageous in that triggering may be performed at the surface by a preselected manipulation of workstring 93. Of course, the preselected manipulation (that is, rapid rotation at rates of between fifty of one hundred revolutions per minute) is also unlikely to be encountered accidentally in the wellbore during run in. Both of these features ensure that firing mechanism 37 will not be accidentally discharged in an undesirable location within the wellbore. Firing mechanism 37 of the present invention is further advantageous in that electromagnetic transmitter portion 85 and electromagnetic receiver portion 87 are carried into the wellbore mounted in such a way that magnet 91 is not aligned with receiver 87, until the wellbore tubular conduit 23 is anchored in the well and workstring 93 is raised or lowered with respect to wellbore tubular conduit 23. One way this can be accomplished is to carry electromagnetic transmitter portion 85 and electromagnetic receiver portion 87 on separate tubing strings.

With reference again to FIG. 3, the relationship between wedge-set sealing flap 35 and shape-memory actuator 33 will be described in detail. As discussed above, wedge-set sealing flap 35 is operable in a plurality of modes, including a radially-reduced running mode and a radially-expanded sealing mode. FIG. 3 is a longitudinal section view of a portion of the preferred embodiment of wedge-set sealing flap 35 in a sealing mode of operation in sealing engagement with wellbore tubular conduit 15 which is disposed radially outward from cylindrical mandrel 21. As shown in FIG. 3, sealing flap 53 is integrally formed in cylindrical mandrel 21, and thus does not rely upon threaded couplings or other connections for its physical placement relative to cylindrical mandrel 21. Sealing flap 53 overlies a region of radially-reduced portion 49 of cylindrical mandrel 21. Sealing flap 53 is separated from radially-reduced portion 49 by annular cavity 51.

In the preferred embodiment, upper and lower seal beads 95, 97 are disposed on the exterior surface of seal flap 53. Upper and lower seal beads 95, 97 are raised in cross-section, and extend around the circumference of seal flap 53, and serve to sealingly engage inner surface 61 of wellbore tubular conduit 15. Thus, wedge-set sealing flap 35 forms a gas-tight barrier between upper and lower annular regions 27, 29 which are disposed between cylindrical mandrel 21 and wellbore tubular conduit 15.

In the preferred embodiment, wedge-set sealing flap 35 is urged between the radially-reduced running mode of operation and the radially-enlarged sealing mode of operation by shape-memory actuator 33. As discussed above, shape-memory actuator 33 includes first and second components 45, 47. In the preferred embodiment, at least second component 47 is formed of a shape-memory material which is urged between a axially-shortened deformed position and an axially-elongated pre-deformation condition by application of thermal energy to heat shape-memory actuator 33 above a selected temperature threshold. In the preferred embodiment, first component 45 comprises a cylindrical wedge having an inclined outer surface 99 which is sloped radially outward from an upper radially-reduced region 101 to a lower radially-enlarged region 103. Inclined outer surface 99 is adapter for slidably engaging inclined inner surface 105 of wedge-set sealing flap 35, which is disposed at the lowermost end of wedge-set sealing flap 35 at the opening of annular cavity 51.

When second component 47 of shape-memory actuator 33 is urged between the shortened deformed position and the axially-lengthened pre-deformation position, first component 45 is urged axially upward into annular cavity 51, causing inclined outer surface 99 to slidably engage inclined inner surface 105 of wedge-set sealing flap 35, to urge wedge-set sealing flap 35 radially outward to force at least one of upper and lower seal beads 35, 37 into tight sealing engagement with inner surface 61 of wellbore tubular conduit 15.

Figure 5:
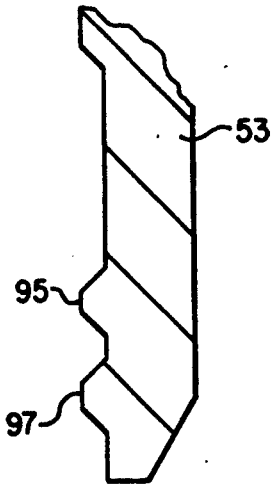
FIG. 5 is a fragmentary longitudinal section view of a portion of the preferred sealing flap of the sealing mechanism in a running mode of operation.

In the preferred embodiment of the present invention, cylindrical mandrel 21 is constructed from 4140 steel. Central bore 31 extends longitudinally through cylindrical mandrel 21, and has a diameter of three inches. In the preferred embodiment, radially-reduced portion 49 of cylindrical mandrel 21 has an outer diameter of 4.5 inches, and radially-enlarged portion 50 of cylindrical mandrel 21 has an outer diameter of 5.5 inches. Preferably, annular cavity 51 extends between radially-reduced portion 49 and radially-enlarged portion 50 of cylindrical mandrel 21, having a length of 1.1 inches and a width of approximately 0.2 inches. Preferably, inclined inner surface 105 of sealing flap 53 is inclined at an angle of thirty degrees from normal. In the preferred embodiment, sealing flap 53 is approximately 1.1 inches long, and has a width of 0.3 inches. Also, in the preferred embodiment, upper and lower seal beads 95, 97 extend radially outward from the exterior surface of sealing flap 53 a distance of 0.04 inches. As shown in FIG. 5, upper and lower seal beads 95, 97 are generally flattened along their outermost surface, and include side portions which are sloped at an angle of forty-five degrees from the outermost surface of sealing flap 53.

In the preferred embodiment of the present invention, first component 45 of shape-memory actuator 33 is formed of 4140 steel, and includes a central bore having a diameter of 4.52 inches, and an outer surface defining an outer diameter of 5.5 inches. In the preferred embodiment, first component 45 is 1.0 inches long, and includes inclined outer surface 99 which is sloped at an angle of approximately thirty degrees from normal. Inclined outer surface 99 begins at radially-reduced region 101, which has a outer diameter of 4.9 inches, in the preferred embodiment, and extends downward to radially-enlarged region 103 which has an outer diameter of 5.5 inches.

It will be appreciate that, at radially-reduced region 101 of first component 45 of shape-memory actuator 33, the wedge-shaped member of first component 45 will be easily insertable within annular cavity 51, since the innermost surface of sealing flap 53 is 4.9 inches in diameter. As first component 45 is urged upward within annular cavity 51, inclined outer surface 99 and inclined inner surface 105 slidably engage, and sealing flap 53 is urged radially outward into gripping and sealing engagement with wellbore tubular conduit 15. In the preferred embodiment of the present invention, sealing flap 53 is adapted to flex 0.17 inches per side. Upper and lower seal beads 95, 97 will engage wellbore tubular conduit 15, with at least one of them forming a fluid-tight and gas-tight seal with wellbore tubular conduit 15.

It is one objective of the present invention to employ shape-memory actuator 33 to drive first component 45 into annular cavity 51 at a high force level, in the range of 150,000 to 500,000 pounds of force. Consequently, first component 45 is driven into annular cavity 51 with such force that the material of cylindrical mandrel 21, first component 45, and sealing flap 53 yields, galls, and sticks together, permanently lodging first component 45 in a fixed position within annular cavity 51, to provide a permanent outward bias to sealing flap 53, keeping it in gripping and sealing engagement with wellbore tubular conduit 15.

In order to accomplish these objectives, at least second component 47 of shape-memory actuator 33 is formed of a shape-memory material. This is a term which is used to describe the ability of some plastically deformed metals and plastics to resume their original shape upon heating. The shape-memory effect has been observed in many metal alloys. Shape-memory materials are subject to a "thermoelastic martensitic transformation", a crystalline phase change that takes place by either twinning or faulting. Of the many shape-memory alloys, Nickle-Titanium (Ni-ti) and Copper-based alloys have proven to be most commercially viable in useful engineering properties. Two of the more common Copper-based shape-memory materials include a Copper-Zinc-Aluminum alloy (Cu-Zn-Al) and a Copper-Aluminum-Nickle alloy (Cu-Al-Ni). Some of the newer, more-promising shape-memory alloys include Iron-based alloys.

Shape-memory materials are sensitive to temperature changes, and will return to a pre-deformation shape from a post-deformation shape, after application of sufficient thermal energy to the shape-memory material. A shape-memory alloy is given a first shape or configuration, and then subjected to an appropriate treatment. Thereafter, its shape or configuration is deformed. It will retain that deformed shape or configuration until such time as it is subjected to a predetermined elevated temperature. When it is subjected to the predetermined elevated temperature, it tends to return to its original shape or configuration. Heating above the predetermined elevated temperature is the only energy input needed to induce high-stress recovery to the original pre-deformation shape. The predetermined elevated temperature is usually referred to as the transition or transformation temperature. The transition or transformation temperature may be a temperature range and is commonly known as the transition temperature range (TTR).

Nickle-based shape-memory alloys were among the first of the shape-memory materials discovered. The predominant shape-memory alloy in the Nickle-based group is a Nickle-Titanium alloy called Nitinol or Tinel. Early investigations on Nitinol started in 1958 by the U.S. Naval Ordinance Laboratory which uncovered the new class of novel Nickle-Titanium alloys based on the ductile intermetallic compound TiNi. These alloys were subsequently given the name Nitinol which is disclosed in U.S. Pat. No. 3,174,851, which issued on Mar. 23, 1965, and which is entitled *Nickle-Based Alloys*; others of the early U.S. patents directed to the Nickle-based shape-memory alloys include U.S. Pat. No. 3,351,463, issued on Nov. 7, 1967, and entitled *High Strength Nickle-Based Alloys*, and U.S. Pat. No. 3,403,238, issued on Sep. 24, 1968, entitled *Conversion of Heat Energy to Mechanical Energy*. All these patents are assigned to the United States of America as represented by the Secretary of the Navy, and all are incorporated herein by reference as if fully set forth herein.

Two commercial Copper-based shape-memory alloy systems are: Cu-Cn-Al and Cu-Al-Ni. Generally, Copper-based alloys are more brittle than Nickle-based alloys. In order to control the grain size, the material must be worked in a hot condition. In addition, Copper-based alloys usually require quenching to retain the austenitic condition at intermediate temperatures, which makes them less stable than the Nickle-based alloys. One technical advantage of the Copper-based shape-memory alloys is that substantially higher transformation temperatures can be achieved as compared with currently available Nickle-based shape-memory alloys. Copper-based shape-memory alloys are also less expensive than Nickle-based shape-memory alloys.

The Nickle-based shape-memory alloys can really provide the greatest proportionate displacement between pre-deformation and post-deformation dimensions. This property is generally characterized as the "recoverable strain" of the shape-memory material. Of the commercially available shape-memory alloys, the Ni-Ti alloy has a recoverable strain of approximately eight percent. The Cu-Cn-Al alloy has a recoverable strain of approximately four percent. The Cu-Al-Ni alloy generally has a recoverable strain of approximately five percent.

FIG. 6a depicts a plot of stress versus strain for the physical deformation of Nickle-based and Copper-based shape-memory materials. In this graph, the X-axis is representative of strain in the material, and the Y-axis is representative of stress on material. Portion 141 of the curve depicts the stress-strain relationship in the material during a loading phase of operation, in which the load is applied to material which is a martensitic condition. In the graph, loading is depicted by arrow 143. Portion 145 of the curve is representative of the material in a defined martensitic condition, during which significant strain is added to the material in response to the addition of relatively low amounts of additional stress. It is during portion 145 of the curve that the shape-memory material is most deformed from a pre-deformation shape to a post-deformation shape. In the preferred embodiment of the present invention, it is during this phase that second component 47 of shape-memory actuator 33 is physically shortened. Portion 147 of the curve is representative of an unloading of the material, which is further represented by arrow 149. The shape-memory material is an austenite condition. Arrows 151, 153, 155 are representative of the response of the material to the application of heat sufficient to return the material from the post-deformation shape to the pre-deformation shape. In the preferred embodiment of the present invention, the operation represented by arrows 151, 153, 157 corresponds to a lengthening of second component 47 of shape-memory actuator 33.

One problem with the use of Nickle-based and Copper-based shape-memory materials is that the maximum triggering temperature can be quite low. For Nickle-based metal alloys, the maximum triggering temperature for commercially available materials is approximately one hundred and twenty degrees Celsius. For Copper-based shape-memory alloys, the maximum triggering temperature for commercially available materials is generally in the range of one hundred and twenty degrees Celsius to one hundred and seventy degrees Celsius. This presents some limitation for use of Nickle-based shape-memory alloys and Copper-based shape-memory alloys in deep wells, which experience high temperatures. Therefore, Nickle-based shape-memory alloys and Copper-based shape-memory alloys may be limited in wellbore use to rather shallow, or low-temperature applications.

The Iron-based shape-memory alloys include three main types: Iron-Manganese-Silicon; Iron-Nickle-Carbon; and Iron-Manganese-Silicon-Nickle-Chrome.

In the preferred embodiment of the present invention, second component 47 of shape-memory actuator 33 is composed of an Iron-Manganese-Silicon-Nickle-Chrome shape-memory alloy which is manufactured by Memry Technologies, Inc. of Brookfield, Conn. In the preferred embodiment, shape-memory alloy has a following composition by percentage of weight: Manganese (Mn): 13.8%; Silicon (Si): 6%; Nickle (Ni): 5%; Chrome (Cr): 8.4%; Iron (Fe): balance. However, in alternative embodiments, Nickle-based shape-memory alloys and Copper-based shape-memory alloys may be used. Several types are available commercially from either Memry Technologies, Inc. of Brookfield, Conn., or Raychem Corporation of Menlow Park, Calif.

In the preferred embodiment of the present invention, second component 47 of shape-memory actuator 33 is approximately six feet long, and is in a cylindrical shape, with an inner diameter of 3.5 inches, and an outer diameter of 5.5 inches. The inner and outer diameters define the cross-sectional area with which second component 47 engages first component 45 in shape-memory actuator 33, and consequently controls the amount of force which may be applied to first component 45.

The Iron-based shape-memory alloys work differently from the Nickle-based alloys and Copper-based alloys, as set forth in flowchart form in FIG. 7. In step 201 the austenite phase is obtained as a starting point. The material in the austenite phase is subjected to deformation is step 203 to obtain a stress-induced martensite phase, as shown in step 205. Heat is applied (over 300 degrees Fahrenheit, preferably) in step 207 which causes second component 47 of shape-memory actuator 33 to return to the austenite phase in step 209, yield an axial force in step 210 and simultaneously regain shape in step 211.

In the preferred embodiment of the present invention, at these steps, second component 47 regains approximately one to two percent of its original length, resulting in the application of a force of approximately one hundred and fifty thousand pounds to first component 45, urging it into annular cavity 51. In step 213, second component 47 of shape-memory actuator 33 cools, resulting in a slight decrease, in step 215, in the force applied by second component 47 to first component 45. This decrease in force will be insignificant.

FIG. 6*b* is a graphic depiction of the stress-strain curve for an iron-based shape-memory alloy. In this graph, the X-axis is representative of strain, and the Y-axis is representative of stress. Portion 163 of the curve is representative of the shape-memory alloy in the austenite phase. Load which is applied to the shape-memory alloy is represented by arrow 161. Loading of the shape-memory material causes it to transform into a stress-induced martensite which is represented on the curve by portion 165. The release of loading is represented by arrow 167. Portion 169 of the curve is representative of application of heat to the material, which causes it to return to the austenite phase. The return of the austenite phase is represented by arrows 171, 173, and 175.

FIGS. 4*a* through 4*d* are longitudinal section views of portions of the preferred embodiment of the wellbore tool of the present invention, in time sequence order, to depict the setting of wedge-set sealing flap 35. Beginning in FIG. 4*a*, workstring 93 is lowered into a desired position within central bore 31 of cylindrical mandrel 21. Workstring 93 is rotated at a rate of between 90 and 100 revolutions per minute, causing permanent magnet 91 to rotate and generate a magnetic field which is picked up by conductor coil 89. Consequently, an electric current is caused to flow through electrical conductor 73 to ignitor 71 which is lodged in the selectively-activated exothermic substance 65 of a selected heating channel 63, as shown in FIG. 4*b*. The current causes ignitor 71 to be actuated triggering an exothermic reaction in selectively actuated exothermic substance 65, which heats second component 47 of shape-memory actuator 33 to a temperature above the transformation temperature.

As shown in FIG. 4*c*, as a consequence of this heating, second component 47 is lengthened a selected amount 107. As shown in FIG. 4*d*, lengthening of second component 47 of shape-memory actuator 33 causes first component 45 to be driven axially upward and into annular cavity 51, where it causes sealing flap 53 to be flexed radially outward from a radially-reduced running position to a radially-expanded sealing position, with at least one of upper and lower seal beads 95, 97 in sealing and gripping engagement with inner surface 61 of wellbore tubular conduit 15. First component 45 is in fact interference fit into annular cavity 51, and thus the materials of sealing flap 53, first component 45, and radially-reduced portion 49 may gall or fuse together to place first component 45 in a fixed position within annular cavity 51. Of course, second component 47 of shape-memory actuator 33 will continue to exert a substantial force against first components 45, even after cooling occurs, and thus will serve as a buttress preventing downward movement of first component relative to annular cavity 51, should the components fail to fuse together.

While the invention has been shown in only one of its forms, it is not thus limited but is susceptible to various changes and modifications without departing from the spirit thereof.

What is claimed is:

1. A wellbore tool for use in a subterranean wellbore, said subterranean wellbore having at least one wellbore tubular conduit disposed therein defining a wellbore surface, comprising:

a first portion, movable in position relative to said wellbore tubular conduit into a selected one of a plurality of configurations, including at least:

a first configuration with said first portion in a first position relative to said wellbore tubular conduit, and corresponding to a first mode of operation of said wellbore tool;

a second configuration with said first portion in a second position relative to said wellbore tubular conduit, and corresponding to a second mode of operation of said wellbore tool;

a second portion, at least in-part including a shape-memory material characterized by having a property of switching between a deformed shape and a pre-deformed shape upon receipt of thermal energy of a preselected amount;

wherein said first portion and said second portion are physically linked in a manner to transfer motion of said second portion to said first portion; and means for selectively providing thermal energy to at least said second portion in an amount of at least said preselected amount to cause said second portion to switch between said deformed shape and said pre-deformed shape which causes said first portion to move from said first position to said second position to urge said wellbore tool from said first mode of operation to said second mode of operation.

2. An apparatus according to claim 1, wherein said first portion and said second portion are in abutting relationship to one another.

3. An apparatus according to claim 1, wherein:

in said first mode of operation, said first portion is out of sealing engagement with said wellbore surface; and in said second mode of operation, said first portion is in sealing engagement with said wellbore surface.

4. An apparatus according to claim 1, wherein said first portion axially expands upon receipt of said thermal energy.

5. An apparatus according to claim 1, wherein said second portion is formed of a shape-memory alloy selected from the group consisting of:

(a) nickel-based shape-memory alloy;

(b) copper-based shape-memory alloy; and (c) copper-based shape memory alloy.

6. An apparatus for use in a subterranean wellbore, comprising:

a wellbore tool disposed in said subterranean wellbore on a wellbore tubular conduit member, being operable in a plurality of operating modes and being switchable between selected operating modes of said plurality of operating modes in response to force of a preselected force level;

an actuator member formed of shape-memory material characterized by having a property of switching between a deformed shape and a pre-deformation shape upon receipt of thermal energy of a preselected amount;

said pre-deformation shape defining an actuation dimension which is alerted in said deformed shape by a preselected displacement distance;

means for selectively providing said thermal energy of said preselected amount to said actuator member;

wherein, upon receipt of said thermal energy, said actuator member switches from said deformed shape to said pre-deformation shape causing at least a portion of said actuator member to regain said actuation dimension; and means for maintaining said actuator member in a position relative to said wellbore tool and said wellbore tubular conduit member to ensure that, upon regaining at least a portion of said actuation dimension, said force of said preselected force level is imparted to said wellbore tool; and wherein said wellbore tool is switched between selected operating modes of said plurality of operating modes in response to receipt of said preselected force level.

7. An apparatus according to claim 6, wherein said wellbore tool is operable for selectively sealing against a selected adjoining wellbore surface, and wherein said wellbore tool is switchable between unsealing and sealing operating modes.

8. An apparatus according to claim 6:

wherein said wellbore tool is switched between selected operating modes of said plurality of operating modes in response to axial force;

wherein said pre-deformation shape defines an axial actuation dimension which is altered in said deformed shape by a preselected axial displacement distance;

wherein said actuator member switches between said deformed shape and said pre-deformation shape upon receipt of said thermal energy by at least a portion of regaining said axial actuation dimension; and wherein regaining of said at least a portion of said axial actuation dimension causes said actuator member to supply said axial force to said wellbore tool to switch it between modes of operation.

9. An apparatus according to claim 6, wherein said means for selectively providing thermal energy includes means for distributing uniformly thermal energy to said actuator member.

10. An apparatus according to claim 6, wherein said actuator member is formed of a shape-memory alloy selected from the group consisting of:

(a) nickel-based shape-memory alloy;

(b) copper-based shape-memory alloy; and (c) iron-based shape-memory alloy.

11. An apparatus according to claim 6, wherein said wellbore tool is coupled to a wellbore tubular conduit string, and wherein said actuator member concentrically surrounds at least a portion of said wellbore tubular conduit string and is placed in axial alignment with said wellbore tool.

12. An apparatus according to claim 6, wherein said actuator member includes at least one compartment for receiving a selectively-activated exothermic substance.

13. An apparatus according to claim 6, wherein said actuator member comprises an elongated member axially aligned with said wellbore tubular conduit member and positioned adjacent said wellbore tool, and wherein said means for maintaining said actuator member operates to limit displacement of said actuator member to a single direction along an axis defined by said wellbore tubular conduit member.

14. An apparatus according to claim 6, further comprising:

means for triggering said means for selectively providing.

15. An apparatus according to claim 6, wherein said wellbore tool is switched between selected operating modes of said plurality of operating modes in response to axial force;

wherein said pre-deformation shape defines an axial actuation dimension which is shortened in said deformed shape by a preselected axial displacement distance;

wherein said actuator switches between said deformed shape and said pre-deformation shape upon receipt of said thermal energy by at least lengthening to regain at least a portion of said axial actuation dimension; and wherein regaining of said at least a portion of said axial actuation dimension causes said actuator member to supply said axial force to said wellbore tool to switch it between modes of operation.

16. A method of operating in a wellbore, with a wellbore tool disposed therein and being of the type operable in a plurality of operating modes and being switchable between selected operating modes of said plurality of operating mode in response to application of force of a preselected force level to a force-sensitive member, comprising:

providing an actuator member formed of shape-memory material characterized by having a property of switching between a deformed shape and a pre-deformed shape upon receipt of thermal energy of a preselected amount, said pre-deformation shape defining an actuation dimension which is altered in said deformed shape by a preselected displacement distance;

providing a wellbore tubular conduit member;

coupling together said wellbore tool, said actuator member, and said tubular conduit member, with said force-sensitive member of said wellbore tool in alignment with said actuator dimension of said actuator member;

lowering said wellbore tubular conduit to a selected location within said wellbore; and selectively applying thermal energy of said preselected amount to said actuator member, causing said actuator member to switch from said deformed shape to said pre-deformation shape which causes said actuator member to regain at least a portion of said actuation dimension and apply force of said preselected force level to said wellbore tool to switch said wellbore tool between selected operating modes of said plurality of operating modes.

17. A method according to claim 16, wherein said step of selectively applying thermal energy includes raising the temperature of said actuator member above an actuation temperature threshold.

18. A method according to claim 16, wherein said step of coupling together comprises securing said wellbore tool and said actuator member exteriorly of said wellbore tubular conduit member and in axial alignment.

19. In a subterranean wellbore tool having at least one wellbore tubular conduit string disposed therein defining a wellbore surface, a method of operating a wellbore tool of the type operable in a plurality of operating modes and being switchable between selected operating modes of said plurality of operating modes, said operating modes including a running mode of operation with said wellbore tool out of engagement with said wellbore surface, and a setting mode of operation with said wellbore tool in engagement with said wellbore surface, comprising:

providing a wellbore tubular conduit member, which includes an external surface;

providing an actuator member which is formed at least in-part of shape-memory material characterized by having a property of switching between a deformed shape and a pre-deformed shape upon receipt of thermal energy of a preselected amount, wherein said deformed shape defines an axial actuation dimension which is decreased in said deformed shape by a preselected displacement distance, and wherein, upon receipt of said thermal energy, said actuator member switches from said deformed shape to said pre-deformed shape;

coupling said wellbore tool and said actuator member to asid wellbore tubular conduit exteriorly of said wellbore tubular conduit and in axial alignment;

lowering said wellbore tubular conduit to a selected location within said wellbore; and selectively applying thermal energy of said preselected amount to said actuator member, causing said actuator member to switch between said deformed shape and said pre-deformed shape with a resulting change in said axial actuation dimension, wherein change in said axial actuation dimension switches said wellbore tool between said running and setting modes of operation.

20. An apparatus for use in a subterranean wellbore having at least one wellbore tubular conduit string disposed therein defining a wellbore surface, comprising:

a wellbore tool disposed in said subterranean wellbore on a wellbore tubular conduit member which is concentrically nested within said at least one wellbore tubular conduit string;

said wellbore tool being operable in a running mode of operation out of engagement with said wellbore surface, and a setting mode of operation in engagement with said wellbore surface;

said wellbore tool being urged between said running mode of operation and said setting mode of operation upon receipt of axial force of a preselected force level;

an actuator member disposed about at least a portion of said wellbore tubular conduit and in abutting relationship with said wellbore tool;

said actuator member formed at least in-part of shape-memory material characterized by having a property of switching between a deformed shape and a pre-deformation shape upon receipt of thermal energy of a preselected amount;

said actuator member having at least one heating channel disposed therein;

a selectively-activated exothermic substance disposed within said heating channel;

wherein said pre-deformation shape defines an axial actuation dimension which is decreased in said deformed shape by a preselected displacement distance;

means for selectively activating said exothermic substance to release thermal energy in an amount of at least said preselected amount;

wherein, upon receipt of said thermal energy, said actuator member switches from said deformed shape to said pre-deformation shape causing said actuator member to elongate by at least a portion of said preselected displacement distance to obtain a length of said axial actuation dimension;

means for maintaining said actuator member in a selected position relative to said wellbore tool and said wellbore tubular conduit member and for ensuring that, upon elongation of said actuator member, axial force of said preselected force level is imparted to said wellbore tool; and wherein said wellbore tool is switched between said running mode of operation and said setting mode of operation in response to receipt of said preselected force level.

21. An apparatus according to claim 20, wherein said wellbore tool operates, in said setting mode of operation, to close and seal an annular space defined between said wellbore surface and said wellbore tubular conduit member.

22. An apparatus according to claim 20, wherein said actuator member is formed of a shape-memory alloy selected from the group consisting of:

(a) nickel-based shape-memory alloy;

(b) copper-based shape-memory alloy; and (c) iron-based shape-memory alloy.

23. An apparatus according to claim 20, wherein said at least one heating channel extends axially through said actuator member.

24. An apparatus according to claim 20, wherein said actuator member comprises a cylindrical sleeve which is carried exteriorly of said wellbore tubular conduit and abuts a shoulder at one end and abuts said wellbore tool at another end.

* * * * *